US009320098B2

(12) United States Patent
Yoo

(10) Patent No.: US 9,320,098 B2
(45) Date of Patent: Apr. 19, 2016

(54) LIGHTING DEVICE AND LIGHT-EMITTING DEVICE

(71) Applicant: LUMENS CO., LTD., Gyeonggi-do (KR)

(72) Inventor: Soo Geun Yoo, Seoul (KR)

(73) Assignee: LUMENS CO., LTD., Yongin-Si (KR)

( * ) Notice: Subject to any disclaimer, the term of this patent is extended or adjusted under 35 U.S.C. 154(b) by 0 days.

(21) Appl. No.: 14/796,011

(22) Filed: Jul. 10, 2015

(65) Prior Publication Data

US 2016/0014860 A1 Jan. 14, 2016

(30) Foreign Application Priority Data

Jul. 11, 2014 (KR) ..... 10-2014-0087561

(51) Int. Cl.
*H05B 37/02* (2006.01)
*H05B 33/08* (2006.01)

(52) U.S. Cl.
CPC ..... *H05B 33/0827* (2013.01); *H05B 33/083* (2013.01)

(58) Field of Classification Search
CPC ..... H05B 33/083; H05B 33/0815; H05B 33/0827; H05B 33/0803; H05B 33/0833; H05B 37/02; H05B 37/029; H05B 37/036
USPC ..... 315/122, 128, 185 R, 191, 291, 294, 315/297, 307, 312, 318, 360
See application file for complete search history.

(56) References Cited

U.S. PATENT DOCUMENTS

| | | | | |
|---|---|---|---|---|
| 7,791,326 | B2 * | 9/2010 | Dahlman | H05B 33/0818 315/224 |
| 8,373,363 | B2 * | 2/2013 | Grajcar | H05B 33/0809 315/192 |
| 8,519,635 | B2 * | 8/2013 | Lin | H05B 33/083 315/122 |
| 8,917,026 | B2 * | 12/2014 | Ferrier | H05B 33/083 315/119 |
| 8,947,004 | B2 * | 2/2015 | Chen | H05B 33/0827 307/31 |
| 9,112,606 | B2 * | 8/2015 | Kim | H04B 10/116 |
| 2013/0141013 | A1 * | 6/2013 | Kodama | F21K 9/56 315/294 |
| 2015/0341997 | A1 * | 11/2015 | Yoo | H05B 33/083 315/191 |

FOREIGN PATENT DOCUMENTS

| | | | |
|---|---|---|---|
| KR | 10-2007-0000654 | A | 1/2007 |
| KR | 10-2012-0078999 | A | 7/2012 |
| KR | 10-2013-0095117 | A | 8/2013 |

OTHER PUBLICATIONS

Korean Office Action mailed Oct. 27, 2015 for Korean Patent Application No. 10-2014-0087561.

* cited by examiner

*Primary Examiner* — Haissa Philogene

(57) ABSTRACT

Disclosed is a light-emitting device configured in such a manner that all light-emitting elements always emit light irrespective of the magnitude of an input voltage when the magnitude of the voltage is higher than the minimum light-emitting voltage, and that the light-emitting elements are connected to each other in parallel when the magnitude of the voltage is small, and connected to each other in series when the magnitude of the voltage is large.

18 Claims, 22 Drawing Sheets

| | CS1 | BS2 | CS2 | BS3 | CS3 | BS4 | CS4 | BS5 | CS5 |
|---|---|---|---|---|---|---|---|---|---|
| P0 | ON | ON | ON | ON | ON | ON | ON | ON | ON |
| P1 | ON | ON | ON | ON | ON | ON | ON | ON | ON |
| P2 | OFF | OFF | ON | ON | ON | ON | ON | ON | ON |
| P3 | OFF | OFF | OFF | OFF | ON | ON | ON | ON | ON |
| P4 | OFF | OFF | OFF | OFF | OFF | OFF | ON | ON | ON |
| P5 | OFF | OFF | OFF | OFF | OFF | OFF | OFF | OFF | ON |

LIGHTING DEVICE AND LIGHT-EMITTING DEVICE

CROSS-REFERENCE TO RELATED PATENT APPLICATION

This application claims the benefit of Korean Patent Application No. 10-2014-0087561, filed on Jul. 11, 2014, in the Korean Intellectual Property Office, the disclosure of which is incorporated herein in its entirety by reference.

BACKGROUND

1. Field

The present invention relates to a lighting device and, more particularly, to a lighting device capable of changing a serial/parallel connection structure of light-emitting elements based on an input voltage.

2. Description of the Related Art

A light-emitting diode (LED) refers a type of semiconductor element capable of implementing light of various colors by forming a light-emitting source using a PN diode of a compound semiconductor. The LED has a long life, a small size, and a small weight, and can be driven using a low voltage. In addition, the LED is durable against impact and vibration, does not require preheating or complicated driving, and is mountable on a substrate or a lead frame in various forms before packaging. As such, the LED may be modularized for various purposes and applied to a backlight unit or a variety of lighting devices.

A plurality of LEDs may be used to provide an independent lighting device. In this case, the LEDs may be connected to each other in series or in parallel. In this case, commercial power may be converted into alternating current (AC) power and the AC power may be provided to the LEDs to always turn on all LEDs.

When the AC power is provided and used as described above, an AC rectifier is necessary. However, the AC power may be directly applied to the LEDs without using the AC rectifier. In this case, the LEDs may be connected to each other in series, and on/off states of the LEDs may be changed based on the magnitude of a variable input voltage. As the on/off states are repeated, flicker of light occurs, usability of each LED is reduced, and thus light output efficiency is reduced.

SUMMARY

The present invention provides a light-emitting diode (LED) lighting device capable of increasing usability of LEDs and improving light output efficiency when alternating current (AC) power is directly applied to the LEDS.

According to an aspect of the present invention, there is provided a lighting device including a light-emitting unit including a current input node, a current output node, a current bypass output node, and a first light-emitting group for emitting light due to a current input to the current input node, a second light-emitting group connected to receive a current output from the current output node, and a flicker controller provided between the current input node and the current bypass output node to turn off the first and second light-emitting groups when a voltage input to the current input node is equal to or lower than a predetermined voltage, wherein the current output node is configured to selectively output a whole or a part of a current input through the current input node, and wherein the current bypass output node is configured to output a remaining part of the current input through the current input node when the current output node outputs only the part of the current.

When the lighting device operates in a steady state, the current bypass output node may be configured to output the remaining part of the current input through the current input node when the current output node outputs the part of the current, and the part of the current may have a value greater than 0.

The remaining part of the current may be at least a part or a whole of a current flowing through the first light-emitting group.

The second light-emitting group may belong to another light-emitting unit including another current input node, another current output node, another current bypass output node, and the second light-emitting group for emitting light due to a current input to the other current input node, and the current bypass output node included in the light-emitting unit may be configured to be connected to the other current bypass output node included in the other light-emitting unit.

Distribution switches may be separately connected between the first light-emitting group and the current output node and between the second light-emitting group and the other current output node, and the flicker controller may turn off the distribution switches to turn off the first and second light-emitting groups using a comparator or a Zener diode connected to the current input node when the voltage input to the current input node is equal to or lower than a predetermined voltage.

The current output node may be configured to output the part of the current when the voltage input to the current input node has a first potential, and to output the whole of the current when the voltage input to the current input node has a second potential higher than the first potential.

According to another aspect of the present invention, there is provided a light-emitting device including a plurality of light-emitting groups electrically connected to each other to be numbered in a direction from an upper stream to a lower stream, and receiving power from a power supply for supplying power having a variable potential, a first bypass unit, a second bypass unit, and a flicker controller for turning off the light-emitting groups when a voltage input from the power supply is equal to or lower than a predetermined voltage, wherein each of the light-emitting groups includes one or more light-emitting elements, wherein the first bypass unit is configured to electrically connect an upper stream node of a first light-emitting group which is arbitrary-numbered, to an upper stream node of a second light-emitting group which is arbitrary-numbered and provided at a lower stream of the first light-emitting group, in an interruptive manner, and wherein the second bypass unit is configured to electrically connect a lower stream node of the first light-emitting group to a lower stream node of the second light-emitting group or a lower stream node of a third light-emitting group which is arbitrary-numbered and provided at a lower stream of the second light-emitting group, in an interruptive manner.

The first bypass unit may be configured to serve as a constant current source when the first bypass unit connects the upper stream node of the first light-emitting group to the upper stream node of the second light-emitting group.

The second bypass unit may be configured to flow a current therethrough when a current flows through the first bypass unit, and not to flow a current therethrough when a current does not flow through the first bypass unit.

According to another aspect of the present invention, there is provided an alternating current (AC) power light-emitting diode (LED) lighting device including a plurality of light-emitting groups linearly and electrically connected to each other to be numbered from an uppermost stream to a lower stream, a first circuit unit for connecting connection nodes between the light-emitting groups to a ground, a second circuit unit for bypass-connecting the connection nodes to each other, and a flicker controller for turning off the light-emitting groups when a voltage input to a light-emitting group of the uppermost stream is equal to or lower than a predetermined voltage, wherein the light-emitting groups are configured to be switched from a parallel connection state to a serial connection state sequentially from the light-emitting group of the uppermost stream to a light-emitting group of the lowermost stream during a potential of supplied AC power is increased, and wherein each of the light-emitting groups includes one or more LED elements.

The light-emitting groups may be configured to be switched from a serial connection state to a parallel connection state sequentially from the light-emitting group of the lowermost stream to the light-emitting group of the uppermost stream during the potential of supplied AC power is reduced.

According to another aspect of the present invention, there is provided a lighting device including a light-emitting unit including a first light-emitting group, a first bypass unit, a second bypass unit, and a current input node commonly connected to an input node of the first light-emitting group and an input node of the first bypass unit to supply a current to the first light-emitting group and the first bypass unit, a second light-emitting group connected to the light-emitting unit to receive a current output from an output node of the first light-emitting group in a first circuit state and to receive a current output from an output node of the first bypass unit in a second circuit state, and a flicker controller connected to the current input node to turn off the first and second light-emitting groups when a voltage input to the current input node is equal to or lower than a predetermined voltage, wherein the first bypass unit is configured to be interrupted not to flow a current therethrough, and the second bypass unit is configured to be interrupted not to flow therethrough the current output from the first light-emitting group, in the first circuit state, and wherein the first bypass unit is configured to flow a current therethrough, and the second bypass unit is configured flow therethrough at least a part of the current output from the first light-emitting group, in the second circuit state.

The second bypass unit may be configured to connect an output node thereof to a current output node of the second light-emitting group.

The second light-emitting group may be included in another light-emitting unit having a configuration equal to the configuration of the light-emitting unit.

The first circuit state may indicate a first time period, and the second circuit state may indicate a second time period different from the first time period.

The first circuit state may indicate a state having a first input voltage level, the second circuit state may indicate a state having a second input voltage level, and the first input voltage level may be higher than the second input voltage level.

According to another aspect of the present invention, there is provided a lighting device including two light-emitting units connected to each other in parallel at a first voltage higher than a turn-on voltage, and a flicker controller for turning off the two light-emitting group when a voltage input to an upper stream node of the two light-emitting units is equal to or lower than a predetermined voltage, wherein the two light-emitting units are switched to a serial connection state at a second voltage higher than the first voltage, and wherein the two light-emitting units are always turned on at a voltage higher than the turn-on voltage.

The two light-emitting units may include light-emitting diodes (LEDs), and the turn-on voltage may be a forward voltage of any one of the two light-emitting units.

A current flowing into the two light-emitting units may have a higher value at the second voltage compared to the first voltage.

According to another aspect of the present invention, there is provided a lighting device including N light-emitting groups linearly connected to each other (N is a natural number equal to or greater than 2), one or more first switching units for bypass-connecting input and output nodes of $1^{st}$ to $(N-1)^{th}$ light-emitting groups to each other, one or more second switching units for connecting output nodes of the $1^{st}$ to $(N-1)^{th}$ light-emitting groups to a ground, and a flicker controller provided between the input node and the second switching unit of the $(N-1)^{th}$ light-emitting group to turn off the N light-emitting groups when a voltage input to the input node is equal to or lower than a predetermined voltage, wherein a first connection node for connecting the output node and the first switching unit of each of the $1^{st}$ to $(N-1)^{th}$ light-emitting groups to each other is provided at a lower steam of a second connection node for connecting the output node and the second switching unit of each of the $1^{st}$ to $(N-1)^{th}$ light-emitting groups to each other, wherein a back-flow preventer for preventing current flow to an upstream is provided between the first and second connection point, and wherein the first and second switching units of the light-emitting groups are sequentially turned on or off and thus the light-emitting groups are connected to each other in parallel and/or in series based on a magnitude of a supplied voltage.

In this case, each of the light-emitting groups may include one or more light-emitting elements connected to each other in series and/or in parallel.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION

Hereinafter, the present invention will be described in detail by explaining embodiments of the invention with reference to the attached drawings. The invention may, however, be embodied in many different forms and should not be construed as being limited to the embodiments set forth herein. The terminology used herein is for the purpose of describing particular embodiments and is not intended to limit the invention. As used herein, the singular forms "a", "an" and "the" are intended to include the plural forms as well, unless the context clearly indicates otherwise.

Figure 1A:
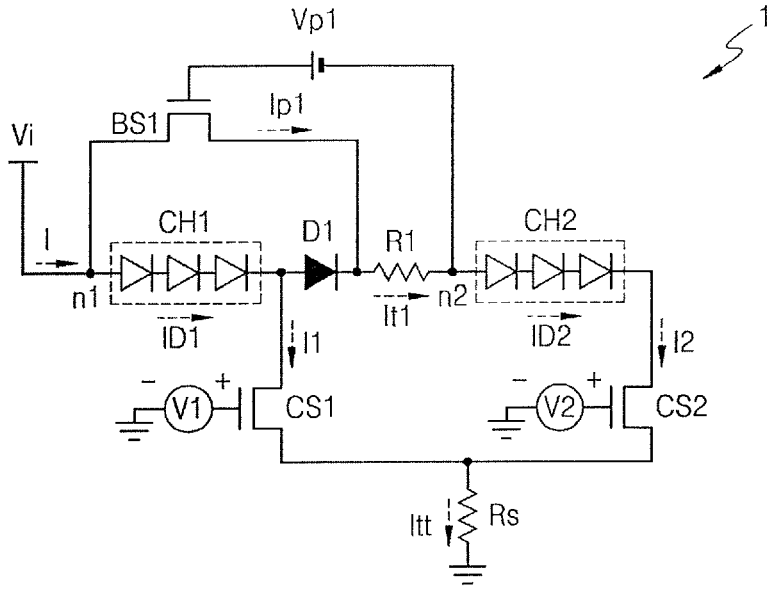
FIGS. 1A and 1B are diagrams showing a light-emitting diode (LED) lighting circuit and the operation principle thereof, according to an embodiment of the present invention.
Figure 1B:
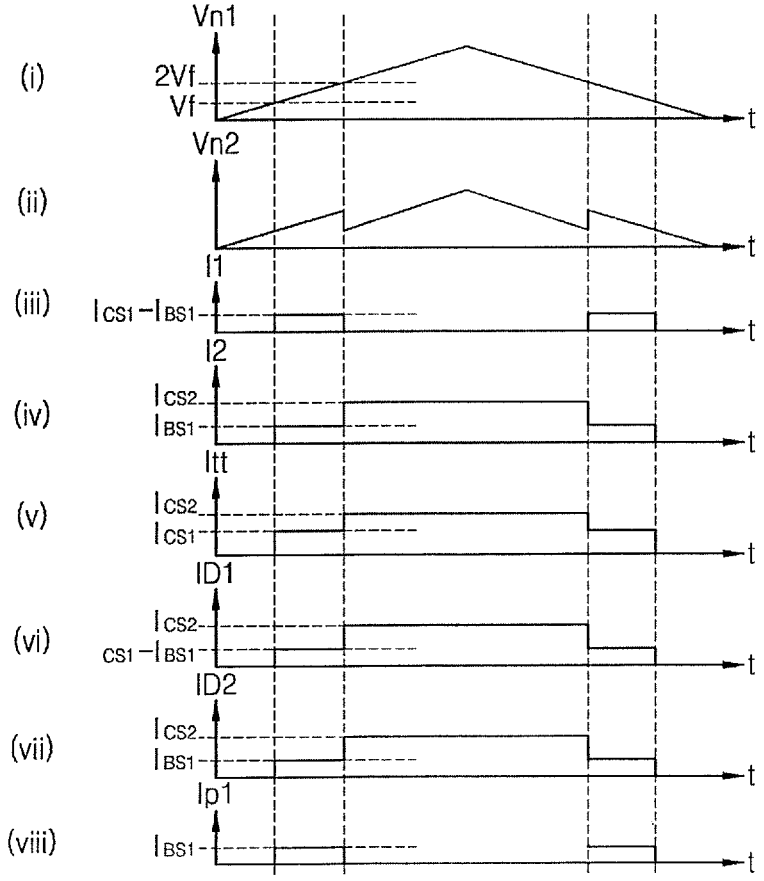

FIGS. 1A and 1B are diagrams showing a light-emitting diode (LED) lighting circuit 1 and the operation principle thereof, according to an embodiment of the present invention.

In the LED lighting circuit 1 illustrated in FIG. 1A, a plurality of light-emitting groups CH1 and CH2 are connected to each other. The light-emitting groups CH1 and CH2 may be switched between a serial connection state and a parallel connection state, and this connection state switching may be performed by controlling on/off states of a distribution switch CS1 and a bypass switch BS1. The on/off states of the distribution switch CS1 and the bypass switch BS1 may be automatically controlling based on the magnitude of an input voltage Vi.

In FIG. 1A, the bypass switch BS1 and the distribution switch CS1 may be configured as transistors. Examples of the transistor include a bipolar transistor (BT), a field effect transistor (FET), and an insulated gate bipolar transistor (IGBT), but are not limited thereto.

When the bypass switch BS1 operates in an unsaturated zone, the magnitude of a current Ip1 flowing through the bypass switch BS1 may be determined based on a ratio of the value of a bias voltage Vp1 to the value of a resistor R1. That is, one current source may be configured using the bypass switch BS1, the current Ip1, and the bias voltage Vp1. Unlike this, when the bypass switch BS1 operates in a saturated zone, the bypass switch BS1 may serve similarly to a resistor.

In addition, when the distribution switch CS1 operates in an unsaturated zone, the magnitude of a current I1 flowing through the distribution switch CS1 may be determined based on a ratio of the value of a bias voltage V1 to the value of a resistor Rs. That is, one current source may be configured using the distribution switch CS1, the current I1, and the bias voltage V1. Unlike this, when the distribution switch CS1 operates in a saturated zone, the distribution switch CS1 may serve similarly to a resistor.

FIG. 1B show voltage and current characteristics based on time at nodes and elements of the LED lighting circuit 1 illustrated in FIG. 1A.

For convenience of explanation, the following description assumes that both the light-emitting groups CH1 and CH2 have a forward voltage of Vf. The following description also assumes that the maximum values of currents capable of flowing through the bypass switch BS1, the distribution switch CS1, and a distribution switch CS2 are designed as $I_{BS1}$, $I_{CS1}$, and $I_{CS2}$, respectively.

When an input voltage Vn1 is between 0 and Vf, no current flows through the LED lighting circuit 1.

When the input voltage Vn1 is between Vf and 2 Vf, the bypass switch BS1 and the distribution switch CS1 may operate in an unsaturated zone and thus serve as current sources, and the distribution switch CS2 may operate in a saturated zone. In this case, a current having a magnitude of $I_{BS1}$ may flow through the bypass switch BS1 and the distribution switch CS2. In this case, the magnitude of a current flowing through the distribution switch CS1 may have a value obtained by subtracting the value $I_{BS1}$ of the current flowing through the distribution switch CS2, from $I_{CS1}$. A current ID1 flowing through the light-emitting group CH1 has the same value as the current flowing through the distribution switch CS1 (i.e., $I_{CS1}-I_{BS1}$), and a current ID2 flowing through the light-emitting group CH2 has the same value as the current flowing though the distribution switch CS2 (i.e., $I_{BS1}$). In this case, since the input voltage Vn1 is not sufficiently high, no current flows through a diode D1.

When the input voltage Vn1 is equal to or higher than 2 Vf, a current can flow through the diode D1. In this case, an additional current flows through the diode D1 into the resistor R1 and thus the bypass switch BS1 is switched to an off state. The distribution switch CS2 operates in an unsaturated zone, and the distribution switch CS1 may be switched to an off state. In this case, a current having a magnitude of $I_{CS2}$ may flow through the distribution switch CS2. The current ID1 flowing through the light-emitting group CH1 has the same value as the current flowing through the distribution switch CS2 (i.e., $I_{CS2}$).

Figure 2:
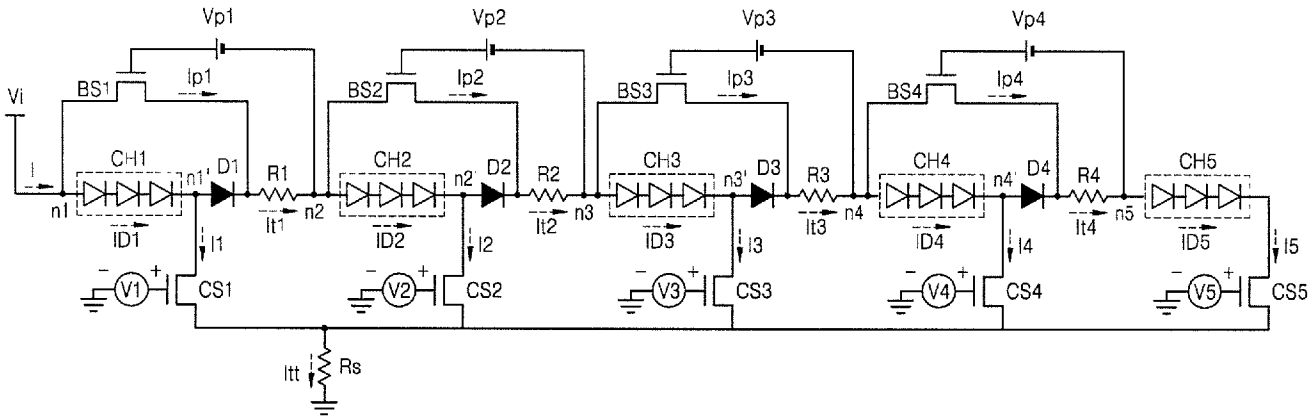
FIG. 2 is a diagram showing an example of an LED lighting circuit according to another embodiment of the present invention.

FIG. 2 is a diagram showing an example of an LED lighting circuit 1 according to another embodiment of the present invention.

The LED lighting circuit 1 illustrated in FIG. 2 is extended and modified from the LED lighting circuit 1 illustrated in FIG. 1A.

In the LED lighting circuit 1 of FIG. 2, a plurality of light-emitting groups CH1 to CH5 are connected to each other. The light-emitting groups CH1 to CH5 may be switched between a serial connection state and a parallel connection state, and this connection state switching may be performed by controlling on/off states of distribution switches CS1 to CS5 and bypass switches BS1 to BS4. The on/off states of the distribution switches CS1 to CS5 and the bypass switches BS1 to BS4 may be automatically controlling based on the magnitude of an input voltage Vi.

In detail, a lighting device including this LED lighting circuit 1 may include the light-emitting groups CH1 to CH5 linearly connected to each other, the bypass switches BS1 to BS4 (or first switching units) for bypass-connecting input and output nodes of the light-emitting groups CH1 to CH4 to each other, respectively, and the distribution switches CS1 to CS5

(or second switching units) for connecting output nodes of the light-emitting groups CH1 to CH5 to the ground, respectively. Here, first connection nodes for connecting the output nodes of the light-emitting groups CH1 to CH4 to the bypass switches BS1 to BS4 (or the first switching units) may be provided at a lower stream of second connection nodes for connecting the output nodes of the light-emitting groups CH1 to CH5 to the distribution switches CS1 to CS5 (or the second switching units), backflow preventers D1 to D4 may be provided between the first and the second connection nodes, and the bypass switches BS1 to BS4 (or the first switching units) and the distribution switches CS1 to CS5 (or the second switching units) of the light-emitting groups CH1 to CH5 may be sequentially turned on or off based on the magnitude of a supplied voltage to connect the light-emitting groups CH1 to CH5 to each other in parallel and/or in series.

In this case, each of the light-emitting groups CH1 to CH5 may include one or more light-emitting elements connected to each other in series and/or in parallel.

Figures 3A, 3B:
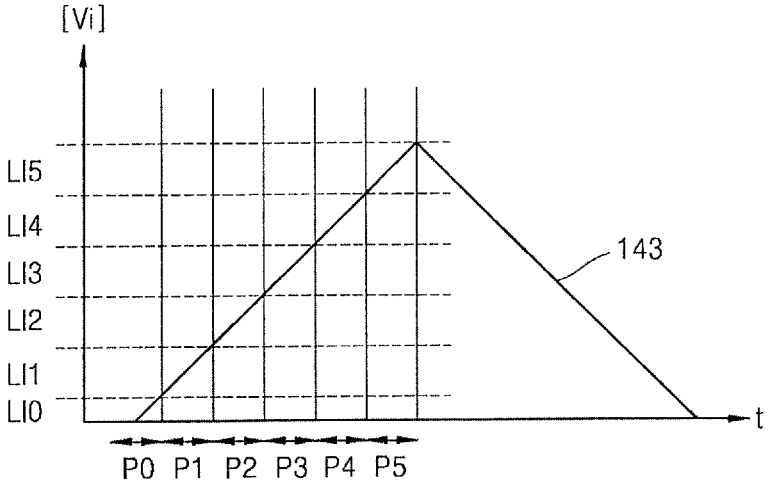
FIGS. 3A and 3B are diagrams showing on/off states of switches included in the LED lighting circuit of FIG. 2, based on an input voltage.

FIGS. 3A and 3B are diagrams showing on/off states of the switches BS1 to BS4 and CS1 to CS5 included in the LED lighting circuit 1 of FIG. 2, based on the input voltage Vi.

A plot line 143 of FIG. 3A shows the magnitude of the input voltage Vi based on time. The input voltage Vi may be given as a triangle wave as shown in FIG. 3A, or given as any other wave such as a circle wave or a sawtooth wave.

The magnitude of the input voltage Vi may be divided into a plurality of voltage periods LI0 to LI5, and each of the voltage periods LI0 to LI5 may correspond to a plurality of time periods P0 to P5. The lengths and positions of the time periods P0 to P5 on a time axis t may be determined based on a predetermined forward voltage value of the light-emitting groups CH1 to CH5 illustrated in FIG. 2.

In the time periods P0 to P5 shown in FIG. 3A, the LED lighting circuit 1 according to an embodiment of the present invention may operate in a steady state. However, the LED lighting circuit 1 may operate in a transient state for switching states thereof between every two of the time periods P0 to P5. The following description is focused on the steady state for convenience of explanation.

Rows of FIG. 3B indicate the time periods P0 to P5, and columns thereof indicate on/off states of the bypass switches BS1 to BS4 and the distribution switches CS1 to CS5 in the time periods P0 to P5. This on/off switching may be automatically performed by the LED lighting circuit 1 illustrated in FIG. 2.

The operation principle of the LED lighting circuit 1 illustrated in FIG. 2 is now described with reference to FIGS. 2 to 5E.

Figure 4A:
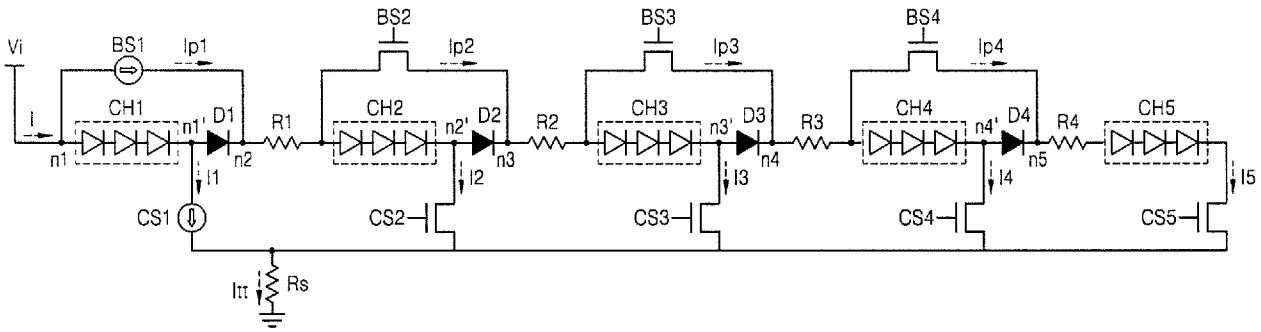
FIGS. 4A to 4E are diagrams showing circuit structures of the LED lighting circuit in a plurality of time periods.

FIGS. 4A to 4E are diagrams showing circuit structures of the LED lighting circuit 1 in the time periods P1 to P5, respectively. Particularly, FIG. 4A illustrates the circuit structure of the LED lighting circuit 1 in the time period P0 as well as the time period P1.

In the time period P0, since the magnitude of the input voltage Vi is not sufficiently high, none of the light-emitting groups CH1 to CH5 may be turned on.

In the time period P1, since the bypass switches BS1 to BS4 and the distribution switches CS1 to CS5 are all turned on, the LED lighting circuit 1 illustrated in FIG. 2 has the circuit structure illustrated in FIG. 4A. In this case, the bypass switch BS1 and the distribution switch CS1 among the turned-on switches may operate in an unsaturated zone and thus serve as current sources. The other switches among the turned-on switches may operate in a saturated zone. In this case, since a voltage of an anode of each of the backflow preventers D1 to D4 is higher than a voltage of a cathode thereof, two ends thereof may be regarded as being open. Accordingly, the circuit illustrated in FIG. 4A may be expressed as an equivalent circuit illustrated in FIG. 5A.

Figure 4B:
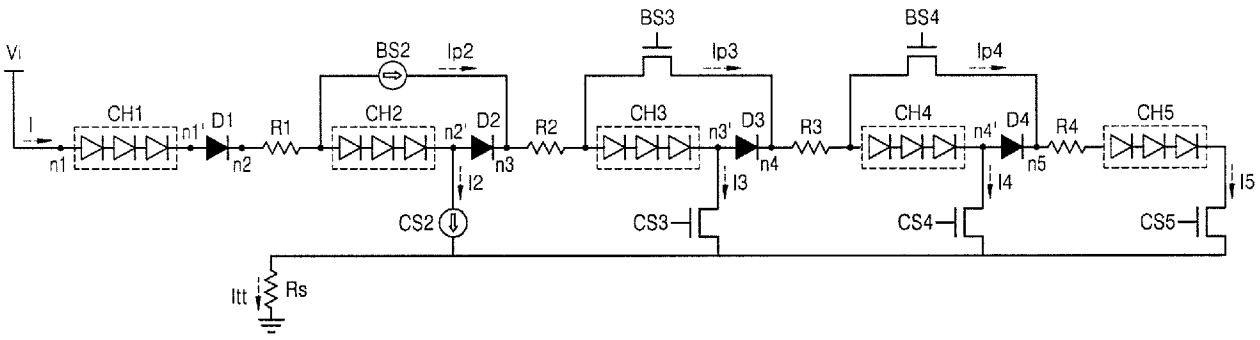

In the time period P2, since the bypass switches BS2 to BS4 and the distribution switches CS2 to CS5 are all turned on and the bypass switch BS1 and the distribution switch CS1 are both turned off, the LED lighting circuit 1 illustrated in FIG. 2 has the circuit structure illustrated in FIG. 4B. In this case, the bypass switch BS2 and the distribution switch CS2 among the turned-on switches may operate in an unsaturated zone and thus serve as current sources. The other switches among the turned-on switches may operate in a saturated zone. In this case, since a voltage of the anode of each of the backflow preventers D2 to D4 is higher than a voltage of the cathode thereof, two ends thereof may be regarded as being open. Accordingly, the circuit illustrated in FIG. 4B may be expressed as an equivalent circuit illustrated in FIG. 5B.

Figure 4C:
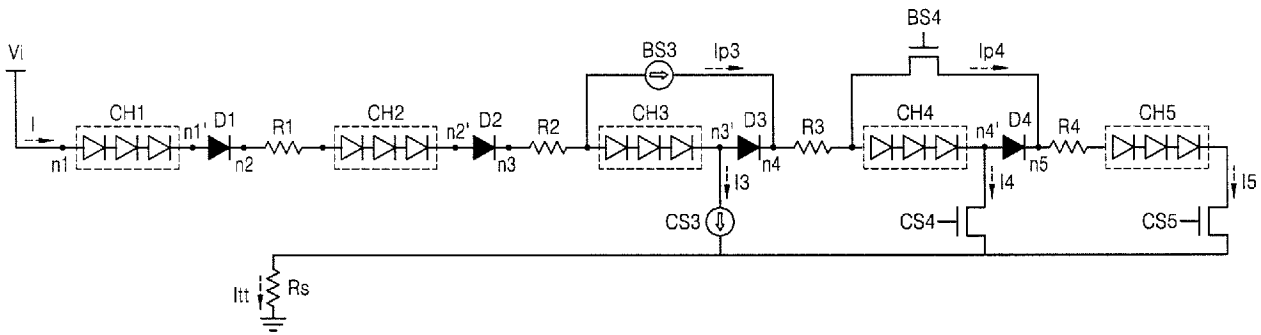

In the time period P3, since the bypass switches BS3 and BS4 and the distribution switches CS3 to CS5 are all turned on and the bypass switches BS1 and BS2 and the distribution switches CS1 and CS2 are all turned off, the LED lighting circuit 1 illustrated in FIG. 2 has the circuit structure illustrated in FIG. 4C. In this case, the bypass switch BS3 and the distribution switch CS3 among the turned-on switches may operate in an unsaturated zone and thus serve as current sources. The other switches among the turned-on switches may operate in a saturated zone. In this case, since a voltage of the anode of each of the backflow preventers D3 and D4 is higher than a voltage of the cathode thereof, two ends thereof may be regarded as being open. Accordingly, the circuit illustrated in FIG. 4C may be expressed as an equivalent circuit illustrated in FIG. 5C.

Figure 4D:
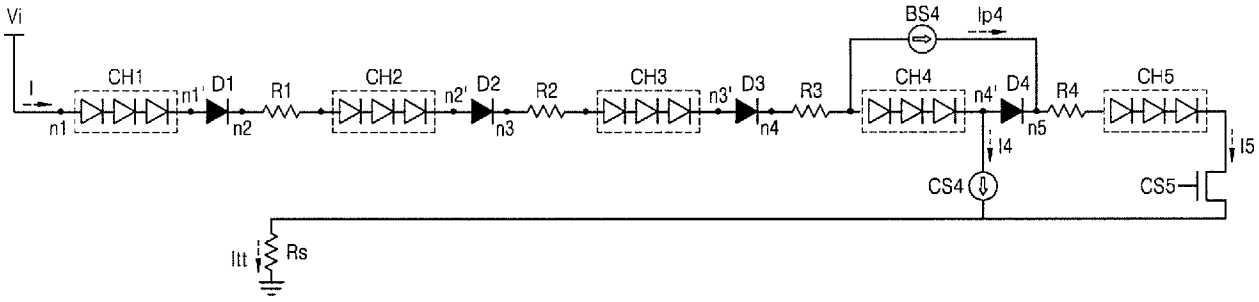

In the time period P4, since the bypass switch BS4 and the distribution switches CS4 and CS5 are all turned on and the bypass switches BS1 to BS3 and the distribution switches CS1 to CS3 are all turned off, the LED lighting circuit 1 illustrated in FIG. 2 has the circuit structure illustrated in FIG. 4D. In this case, the bypass switch BS4 and the distribution switch CS4 among the turned-on switches may operate in an unsaturated zone and thus serve as current sources. The other switch among the turned-on switches may operate in a saturated zone. In this case, since a voltage of the anode of the backflow preventer D4 is higher than a voltage of the cathode thereof, two ends thereof may be regarded as being open. Accordingly, the circuit illustrated in FIG. 4D may be expressed as an equivalent circuit illustrated in FIG. 5D.

Figure 4E:
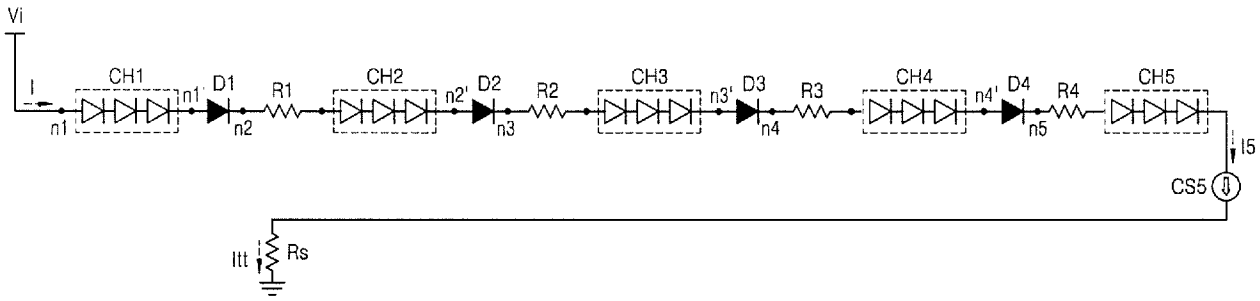

In the time period P5, since the distribution switch CS5 is turned on and the bypass switches BS1 to BS4 and the distribution switches CS1 to CS4 are all turned off, the LED lighting circuit 1 illustrated in FIG. 2 has the circuit structure illustrated in FIG. 4E. In this case, the distribution switch CS5 may operate in an unsaturated zone and thus serve as a current source. The circuit illustrated in FIG. 4E may be expressed as an equivalent circuit illustrated in FIG. 5E.

As described above, the circuits illustrated in FIGS. 5A to 5E may be understood as equivalent circuits approximated from the circuits illustrated in FIGS. 4A to 4E, respectively.

The equivalent circuits illustrated in FIGS. 5A to 5E show that the circuit structure of the LED lighting circuit 1 illustrated in FIG. 2 is changed based on the magnitude of the input voltage Vi.

Figure 5A:
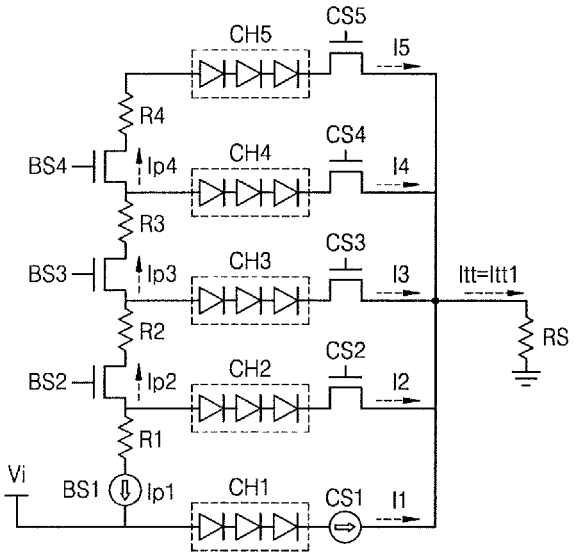
FIGS. 5A to 5E are diagrams showing equivalent circuits approximated from the circuits illustrated in FIGS. 4A to 4E, respectively.

In FIG. 5A showing the time period P1, the light-emitting groups CH1 to CH5 are connected to each other in parallel.

Figure 5B:
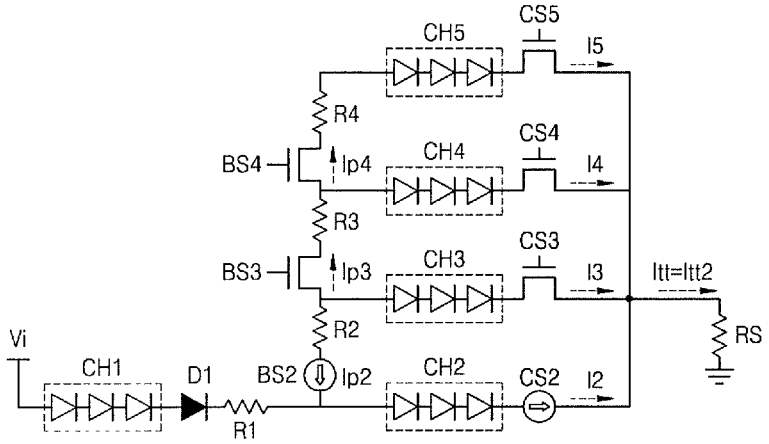

In FIG. 5B showing the time period P2, the light-emitting groups CH2 to CH5 are connected to each other in parallel, and the light-emitting group CH1 is connected thereto in series.

Figure 5C:
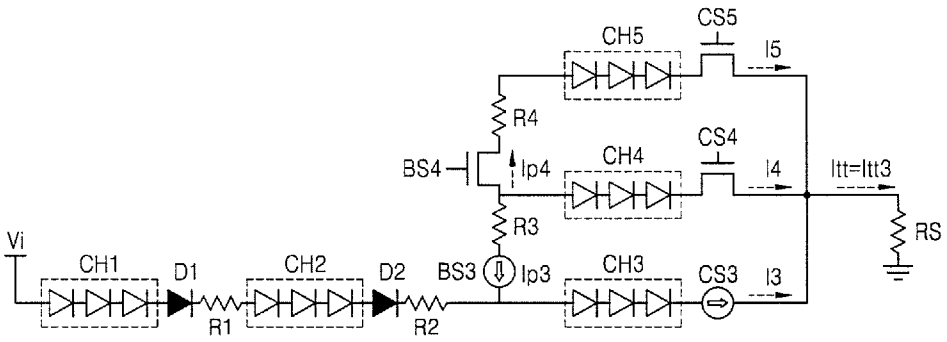

In FIG. 5C showing the time period P3, the light-emitting groups CH3 to CH5 are connected to each other in parallel, and the light-emitting groups CH1 and CH2 are connected thereto in series.

Figure 5D:
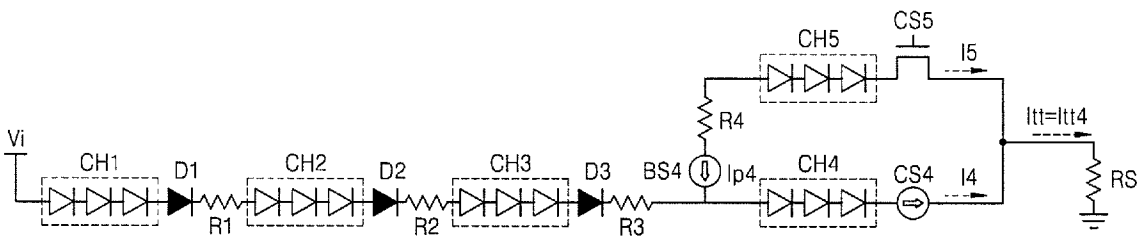

In FIG. 5D showing the time period P4, the light-emitting groups CH4 and CH5 are connected to each other in parallel, and the light-emitting groups CH1 to CH3 are connected thereto in series.

Figure 5E:
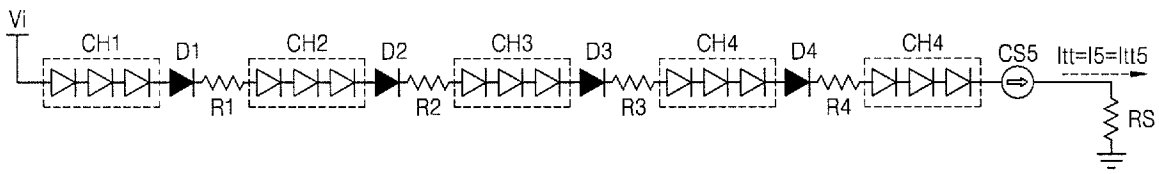

In FIG. 5E showing the time period P5, the light-emitting groups CH1 to CH5 are connected to each in series.

In the circuits of FIGS. 5A to 5E, a sum of currents input to and output from the LED lighting circuit 1 in the time periods P1 to P5 may be defined as Itt1, Itt2, Itt3, Itt4, and Itt5, respectively. In this case, the LED lighting circuit 1 may be designed to satisfy Itt5>Itt4>Itt3>Itt2>Itt1. Using the above design, since the sum of supplied currents is increased as the magnitude of the input voltage Vi is increased, a power factor of the LED lighting circuit 1 may be improved.

An embodiment of the design satisfying Itt5>Itt4>Itt3>Itt2>Itt1 is now described with reference to FIGS. 5A to 5E.

In FIG. 5A, the distribution switch CS1 operates in an unsaturated zone, and the value of I1 is adjusted in such a manner that the value of I1+I2+I3+I4+I5 is the same as the maximum current value $I_{CS1}$ allowed by the distribution switch CS1. In this case, a ratio of I1 to a sum of I2+I3+I4+I5 may be determined based on the maximum current value $I_{BS1}$ provided when the bypass switch BS1 operates as a current source. Accordingly, Itt1=$I_{CS1}$ is satisfied.

In FIG. 5B, the distribution switch CS2 operates in an unsaturated zone, and the value of I2 is adjusted in such a manner that the value of I2+I3+I4+I5 is the same as the maximum current value $I_{CS2}$ allowed by the distribution switch CS2. In this case, a ratio of I2 to a sum of I3+I4+I5 may be determined based on the maximum current value $I_{BS2}$ provided when the bypass switch BS2 operates as a current source. Accordingly, Itt2=$I_{CS2}$ is satisfied.

In FIG. 5C, the distribution switch CS3 operates in an unsaturated zone, and the value of I3 is adjusted in such a manner that the value of I3+I4+I5 is the same as the maximum current value $I_{CS3}$ allowed by the distribution switch CS3. In this case, a ratio of I3 to a sum of I4+I5 may be determined based on the maximum current value $I_{BS3}$ provided when the bypass switch BS3 operates as a current source. Accordingly, Itt3=$I_{CS3}$ is satisfied.

In FIG. 5D, the distribution switch CS4 operates in an unsaturated zone, and the value of I4 is adjusted in such a manner that the value of I4+I5 is the same as the maximum current value $I_{CS4}$ allowed by the distribution switch CS4. In this case, a ratio of I4 to I5 may be determined based on the maximum current value $I_{BS4}$ provided when the bypass switch BS4 operates as a current source. Accordingly, Itt4=$I_{CS4}$ is satisfied.

In FIG. 5E, the distribution switch CS5 operates in an unsaturated zone. Accordingly, Itt5=$I_{CS5}$ is satisfied.

To make relative brightness levels of the light-emitting groups CH1 to CH5 as uniform as possible at a predetermined timing, the maximum current values providable when the switches CS1 to CS5 and BS1 to BS4 serve as current sources may be optimized.

Figure 6A:
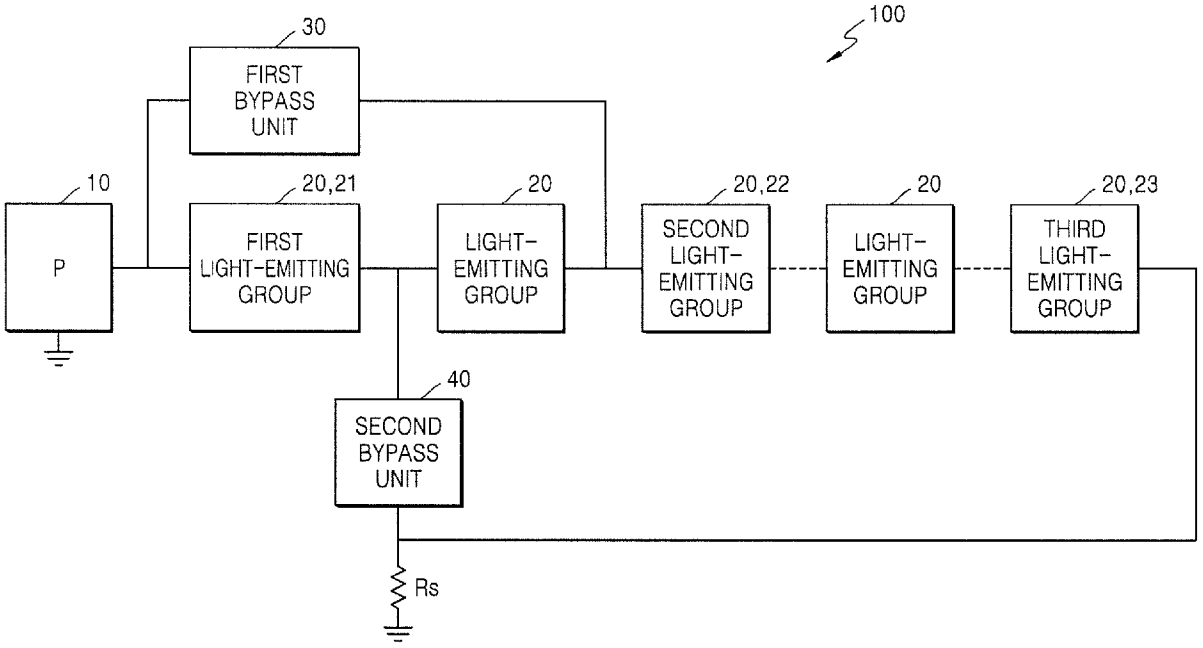
FIG. 6A is a diagram showing the structure of a light-emitting device according to an embodiment of the present invention.

FIG. 6A is a diagram showing the structure of a light-emitting device 100 according to an embodiment of the present invention.

In FIG. 6A, the light-emitting device 100 may be the above-described LED lighting circuit 1.

The light-emitting device 100 may include a power supply 10 for supplying power having a variable potential, and a plurality of light-emitting groups 20.

In this case, each of the light-emitting groups 20 includes one or more light-emitting elements. The light-emitting groups 20 are electrically connected to each other to be numbered in a direction from an upper stream to a lower stream, and are configured to receive power supplied from the power supply 10. Here, the 'upper stream' may refer to a direction closer to a current output node of the power supply 10, and the 'lower stream' may refer to a direction farther away from the current output node of the power supply 10.

The light-emitting device 100 may further include a first bypass unit 30 for electrically connecting an upper stream node of a first light-emitting group 20, 21 which is arbitrary-numbered, to an upper stream node of a second light-emitting group 20, 22 which is arbitrary-numbered and provided at a lower stream of the first light-emitting group 20, 21, in an interruptive manner. Here, the 'upper stream node' may refer to a node closer to the power supply 10 between nodes provided to each light-emitting group (i.e., a current input node), and a 'lower stream node' may refer to a node farther away from the power supply 10 between nodes provided to each light-emitting group (i.e., a current output node). Here, the 'interruptive manner' mean that a current flowing channel can be formed or interrupted between two nodes provided by the first bypass unit 30.

The light-emitting device 100 may further include a second bypass unit 40 for electrically connecting a lower stream node of the first light-emitting group 20, 21 to a lower stream node of the second light-emitting group 20, 22 or a lower stream node of a third light-emitting group 20, 23 which is arbitrary-numbered and provided at a lower stream of the second light-emitting group 20, 22, in an interruptive manner. Here, the 'interruptive manner' mean that a current flowing channel can be formed or interrupted between two nodes provided by the second bypass unit 40.

Figure 6B:
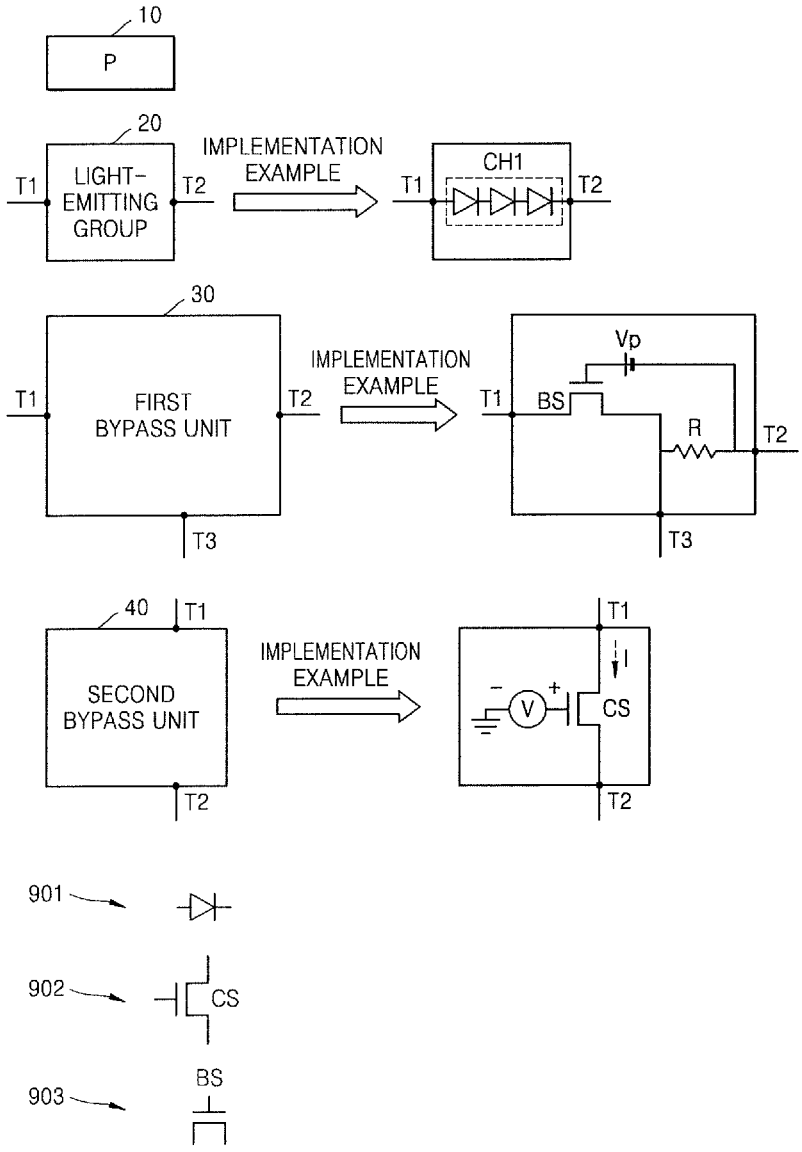
FIG. 6B is a diagram showing a power supply, a light-emitting group, a first bypass unit, a second bypass unit, and a light-emitting element illustrated in FIG. 6A.

FIG. 6B is a diagram showing the power supply 10, the light-emitting group 20, the first bypass unit 30, the second bypass unit 40, and the light-emitting element 901 illustrated in FIG. 6A. FIG. 6B also shows specific implementation examples of the light-emitting group 20, the first bypass unit 30, and the second bypass unit 40. These implementation examples are applied to the LED lighting circuit 1 of FIG. 2. In this case, a circuit between two nodes T1 and T2 provided by the first bypass unit 30 may be interrupted by a bypass switch 903 BS. Another node T3 may be selectively provided to the first bypass unit 30 according to an embodiment. A circuit between two nodes T1 and T2 provided by the second bypass unit 40 may be interrupted by a distribution switch 902 CS.

In the following embodiments of the present invention, the power supply 10 may also be called a 'rectifier'.

The light-emitting group 20 may also be called a 'light-emitting channel' or an 'LED light-emitting group'.

The first bypass unit 30 may also be called a 'jump circuit unit', a 'bypass line', or a 'first circuit unit'.

The second bypass unit 40 may also be called a 'distribution circuit unit' or a 'second circuit unit'.

The light-emitting element 901 may also be called an 'LED cell' or an 'LED element'.

The bypass switch 903 may also be called a 'jump switch'.

Figure 7:
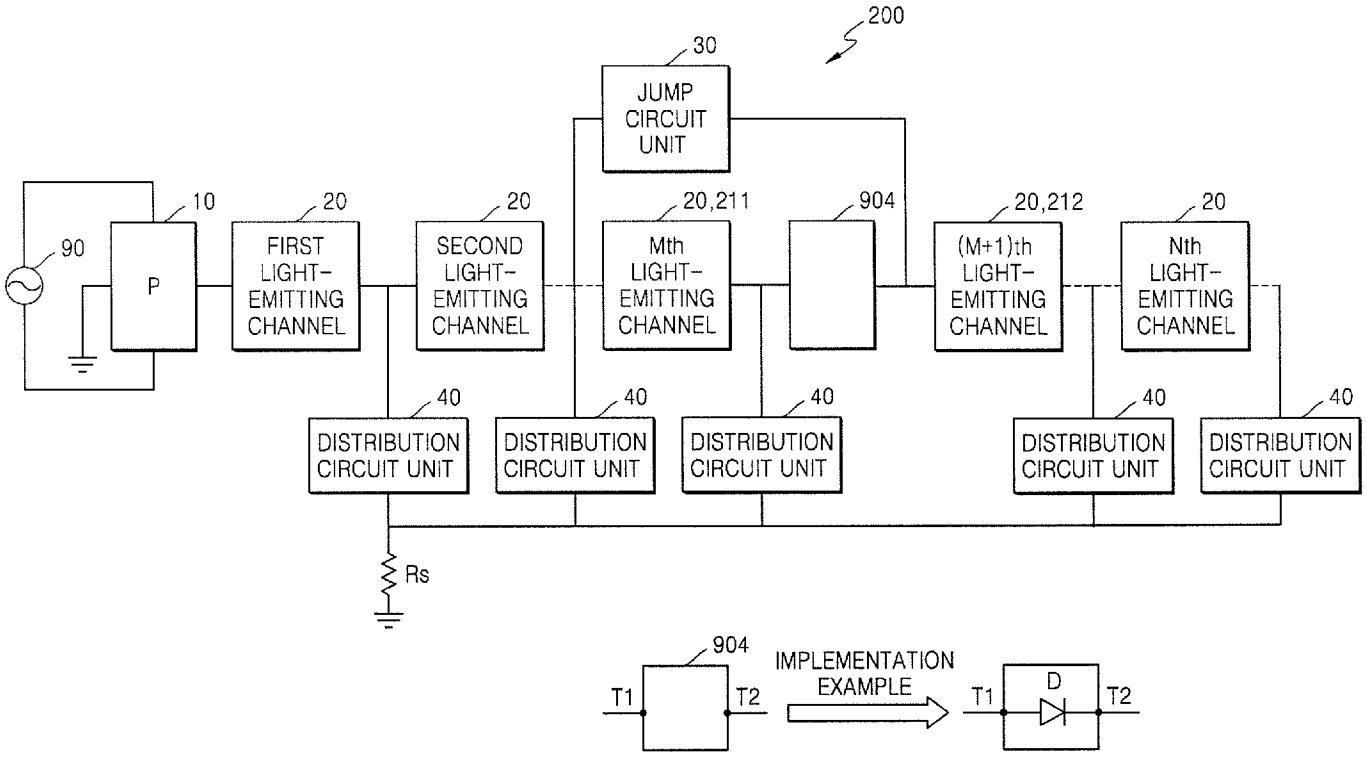
FIG. 7 is a diagram showing the structure of an LED lighting device according to another embodiment of the present invention.

FIG. 7 is a diagram showing the structure of an LED lighting device 200 according to another embodiment of the present invention.

The LED lighting device 200 may receive alternating current (AC) power 90 as operation power.

The LED lighting device 200 includes one or more LED cells 901, and may include N light-emitting channels 20 linearly connected to each other (N is a natural number equal to or greater than 2).

The LED lighting device 200 may further include a rectifier 10 electrically connected to an initial node of the light-emitting channels 20 to rectify the AC power 90 to be supplied to a last node of the light-emitting channels 20. Here, the initial node may refer to a light-emitting channel provided closest to a current output node of the rectifier 10 among the light-emitting channels 20, and the last node may refer to a light-emitting channel provided farthest away therefrom.

The LED lighting device 200 may further include a plurality of distribution circuit units 40 each extending from a connection node between two light-emitting channels 20, connected to the ground, and including a distribution switch 902 for interrupting a current flowing through a connection path thereof.

The LED lighting device 200 may further include a jump circuit unit 30 extending from an input node of an $M^{th}$ light-emitting channel 20, 211 among the light-emitting channels 20, connected to an input node of an $(M+1)^{th}$ light-emitting channel 20, 212, and including a jump switch 903 for interrupting a current flowing through a connection path thereof (M is a natural number equal to or greater than 1 and equal to or less than N−1).

The LED lighting device 200 may further include a backflow preventer 904 provided on a line between a connection node between the $M^{th}$ light-emitting channel 20, 211 and the $(M+1)^{th}$ light-emitting channel 20, 212, and the input node of the $(M+1)^{th}$ light-emitting channel 20, 212 to prevent a current flowing through the jump circuit unit 30 to the input node of the $(M+1)^{th}$ light-emitting channel 20, 212 from flowing back toward the rectifier 10.

FIG. 7 also shows an implementation example of the backflow preventer 904. The backflow preventer 904 may be implemented as a diode D or a transistor. Examples of the transistor are as described above. This implementation example is applied to the LED lighting circuit 1 illustrated in FIG. 2. The backflow preventer 904 may be implemented as a transistor other than a diode D. In this case, an on/off state of the transistor may be controlled based on the time periods P0 to P5 shown in FIG. 3.

The jump circuit unit 30, the light-emitting channels 20, and the distribution circuit units 40 illustrated in FIG. 7 may be implemented to have the same structures as the first bypass unit 30, the light-emitting groups 20, and the second bypass unit 40 illustrated in FIG. 6A, respectively.

Figure 8:
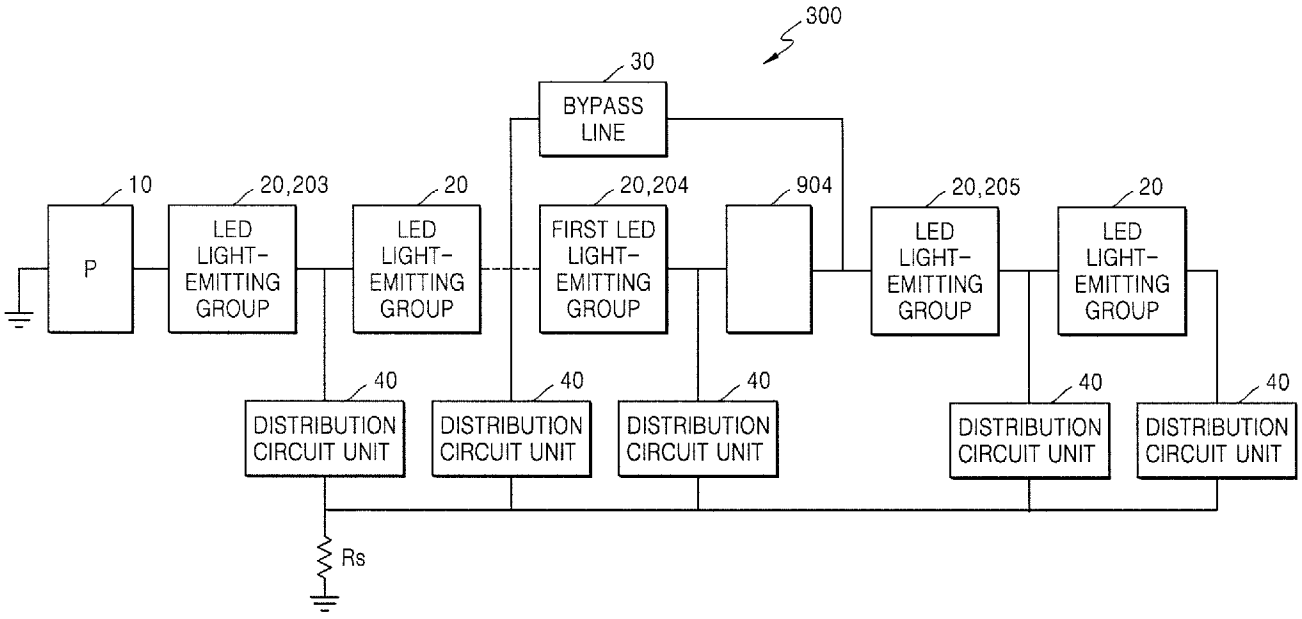
FIG. 8 is a diagram showing the structure of an LED lighting device according to another embodiment of the present invention.

FIG. 8 is a diagram showing the structure of an LED lighting device 300 according to another embodiment of the present invention.

The LED lighting device 300 may have a structure in which a plurality of LED light-emitting groups 20 each including one or more LED elements 901 are sequentially connected to each other.

The LED lighting device 300 may include a power supply 10 for supplying AC power to an LED light-emitting group 20, 203 provided at one end of the LED light-emitting groups 20.

The LED lighting device 300 may further include a bypass line 30 for interconnecting input and output nodes of a first LED light-emitting group 20, 204 corresponding to at least one of the LED light-emitting groups 20.

The LED lighting device 300 may further include a bypass switch 903 provided on the bypass line 30 to close the bypass line 30 when the potential of the power supplied by the power supply 10 is not higher than the potential of power capable of turning on an LED light-emitting group 20, 205 next to the first LED light-emitting group 20, 204.

The bypass line 30, the LED light-emitting groups 20, and distribution circuit units 40 illustrated in FIG. 8 may be implemented to have the same structures as the first bypass unit 30, the light-emitting groups 20, and the second bypass unit 40 illustrated in FIG. 6A, respectively. In this case, since the above-described backflow preventer 904 is provided between a current output node of the bypass line 30 and a current output node of the first LED light-emitting group 20, 204, a current output from the current output node of the bypass line 30 may be prevented from flowing toward the first LED light-emitting group 20, 204.

Figure 9:
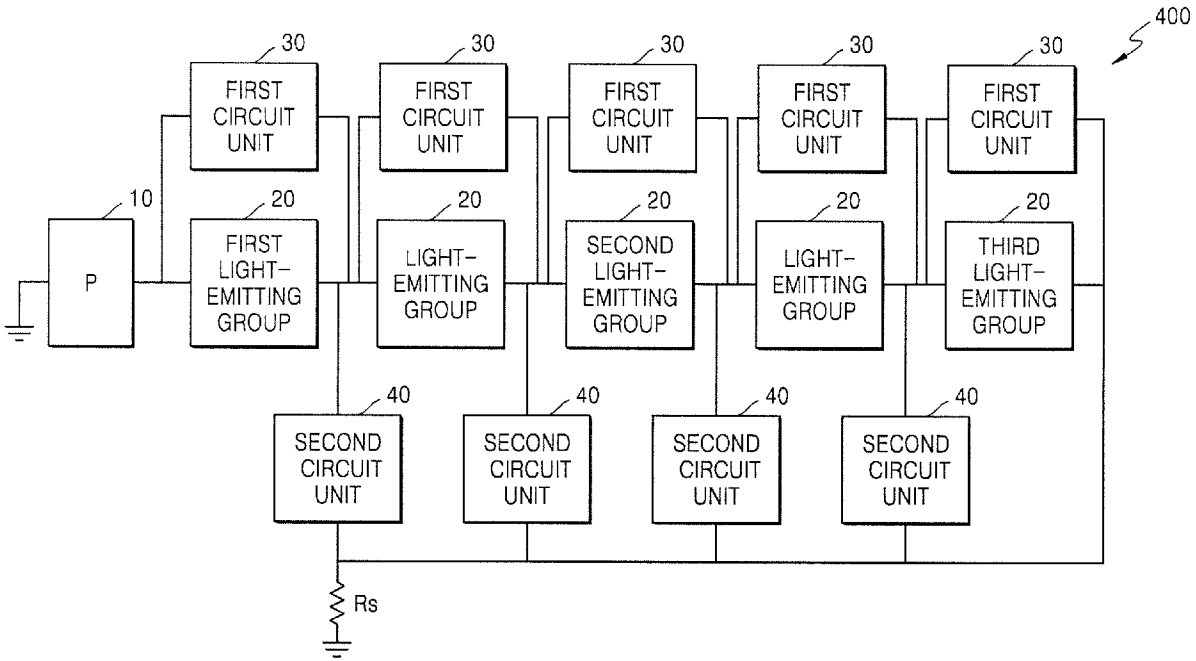
FIG. 9 is a diagram showing the structure of an LED lighting device according to another embodiment of the present invention.

FIG. 9 is a diagram showing the structure of an LED lighting device 400 according to another embodiment of the present invention.

The LED lighting device 400 may receive AC power 10 as operation power.

The LED lighting device 400 may include a plurality of light-emitting groups 20. In this case, each of the light-emitting groups 20 may include one or more LED elements 901, and the light-emitting groups 20 may be linearly and electrically connected to each other to be numbered from the uppermost stream to the lowermost stream. Here, the 'uppermost stream' refers to the closest location to a current output node of the power supply 10, and the 'lowermost stream' refers to the farthest location therefrom.

The LED lighting device 400 may further include first circuit units 30 for bypassing connection nodes between the light-emitting groups 20.

The LED lighting device 400 may further include second circuit units 40 for connecting the connection nodes to the ground in such a manner that AC power is supplied to a lower stream light-emitting group earlier than an upper stream light-emitting group among the light-emitting groups 20 while the potential of the supplied AC power 10 is being increased.

In this case, a backflow preventer may be prevented between a current output node of an arbitrary light-emitting group 20 and a current output node of the first circuit unit 30 configured to bypass a current capable of flowing through the arbitrary light-emitting groups 20. In this case, a current output from the current output node of the first circuit unit 30 may not pass through the backflow preventer.

Figure 10A:
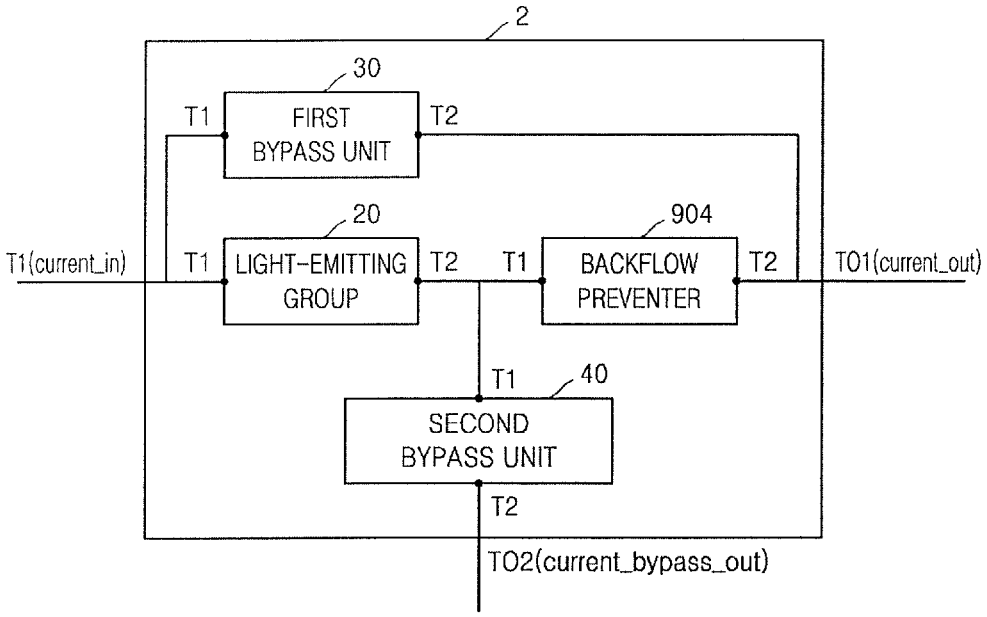
FIGS. 10A to 10C are diagrams showing an example of a light-emitting unit included in an LED lighting circuit, according to an embodiment of the present invention.
Figure 10B:
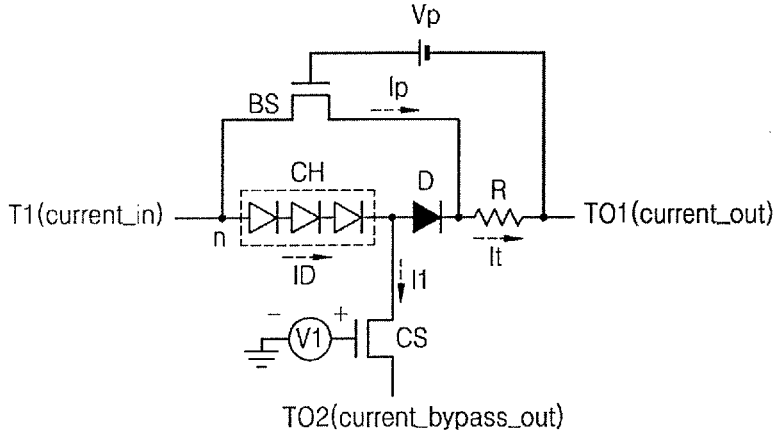
Figure 10C:
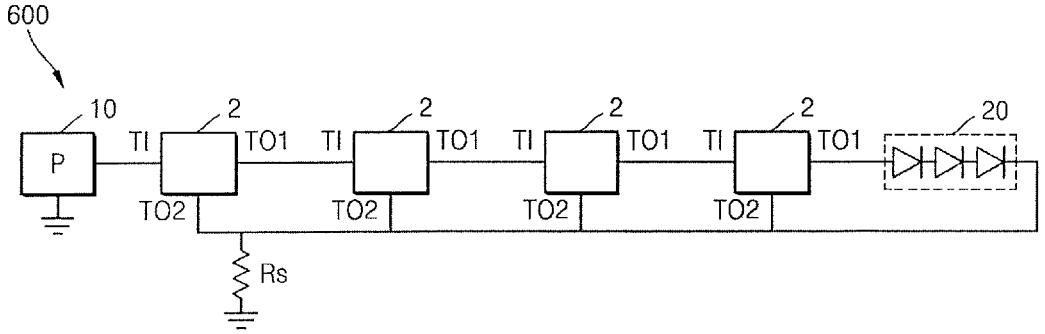

FIGS. 10A to 10C are diagrams showing an example of a light-emitting unit 2 included in an LED lighting circuit, according to an embodiment of the present invention.

FIG. 10A is a block diagram of the light-emitting unit 2 according to an embodiment of the present invention. The light-emitting unit 2 may have three input and output nodes, e.g., a current input node TI, a current output node TO1, and a current bypass output node TO2.

The light-emitting unit 2 may include a first bypass unit 30, a light-emitting group 20, and a second bypass unit 40. The light-emitting unit 2 may selectively include a backflow preventer 904.

When two nodes of the first bypass unit 30 are connected to each other (i.e., when a current flows through the first bypass unit 30), two nodes of the second bypass unit 40 may be connected to each other (i.e., a current may flow through the second bypass unit 40). When the two nodes of the first bypass unit 30 are open (i.e., when no current flows through the first bypass unit 30), the two nodes of the second bypass unit 40 may also be open (i.e., no current may flow through the second bypass unit 40).

Accordingly, when the two nodes of the first bypass unit 30 are connected to each other, a part of a current input through the current input node TI may be input to the light-emitting group 20 and the other part thereof may be bypassed along a path provided by the first bypass unit 30. At least a part or the whole of a current output from an output node of the light-emitting group 20 may not be output to the current output node TO1 but may be bypassed through the second bypass unit 40 and output to the current bypass output node TO2. The current passing through the path provided by the first bypass unit 30 may be output to the current output node TO1.

Unlike this, when the two nodes of the first bypass unit 30 are open, the current input through the current input node TI is completely input to the light-emitting group 20. The current output from the output node of the light-emitting group 20 may be completely output to the current output node TO1.

A resistor may be connected to the current bypass output node TO2. The resistor may be, for example, the resistor Rs of FIG. 2. The value of a current flowing through a distribution switch CS of FIG. 10B may be determined based on the value of the resistor and the value of a voltage V input to the distribution switch CS.

FIG. 10B shows an implementation example of the light-emitting unit 2 illustrated in FIG. 10A. The implementation example of the light-emitting unit 2 according to FIG. 10B is applied to the LED lighting circuit 1 of FIG. 2.

FIG. 10C illustrates an LED lighting circuit 600 achieved by interconnecting the light-emitting units 2 illustrated in FIG. 10A, according to an embodiment of the present invention.

The LED lighting circuit 600 may include one or more light-emitting units 2 each including the light-emitting group 20, the current input node TI, the current output node TO1, and the current bypass output node TO2.

In this case, the current output node TO1 is configured to selectively output the whole or a part of a current input through the current input node TI. The current bypass output node TO2 is configured to output the other part of the current when the current output node TO1 outputs the part of the current. In this case, the other part of the current may be a current flowing through the light-emitting group 20.

The current output node TO1 of the light-emitting unit 2 may be connected to another light-emitting group 20. In this case, the other light-emitting group 20 may or may not be included in another light-emitting unit 2.

The current bypass output node TO2 of the light-emitting unit 2 may be connected to a current output node of another light-emitting group 20. In this case, the other light-emitting group 20 may or may not be included in another light-emitting unit 2.

Meanwhile, an LED lighting device driven using AC power may adjust a brightness level thereof using a triac dimmer. However, when the triac dimmer is used, if a voltage applied to an LED is reduced at a low brightness level, jittering of an output waveform of the triac dimmer may be delivered to the LED and thus the LED may flicker.

Figure 15:
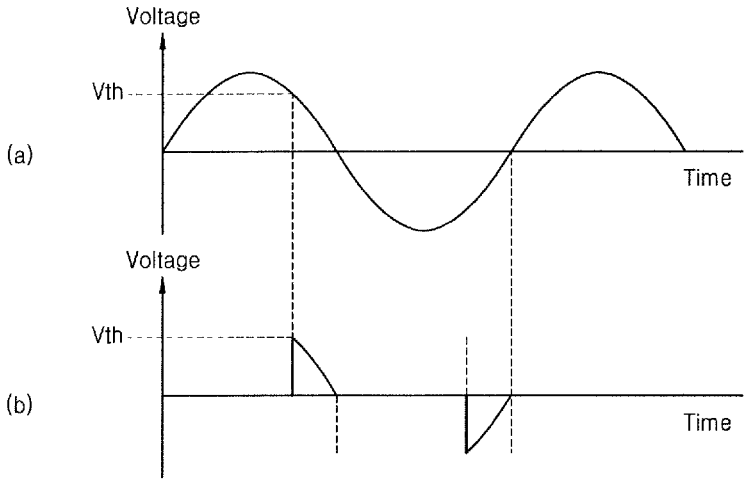
FIG. 15 shows graphs illustrating an alternating current (AC) input waveform and an output waveform of a triac dimmer.

Referring to FIG. 15, in the case of the output waveform of the triac dimmer (see (b) of FIG. 15), jitters in phase may occur at low dimming and thus flicker of light may be caused. (a) of FIG. 15 shows an AC input waveform.

A description is now given of a dimming control LED lighting circuit included in an LED lighting circuit according to the previous embodiment to prevent flicker of light when a triac dimmer is applied to the LED lighting circuit.

Figure 11:
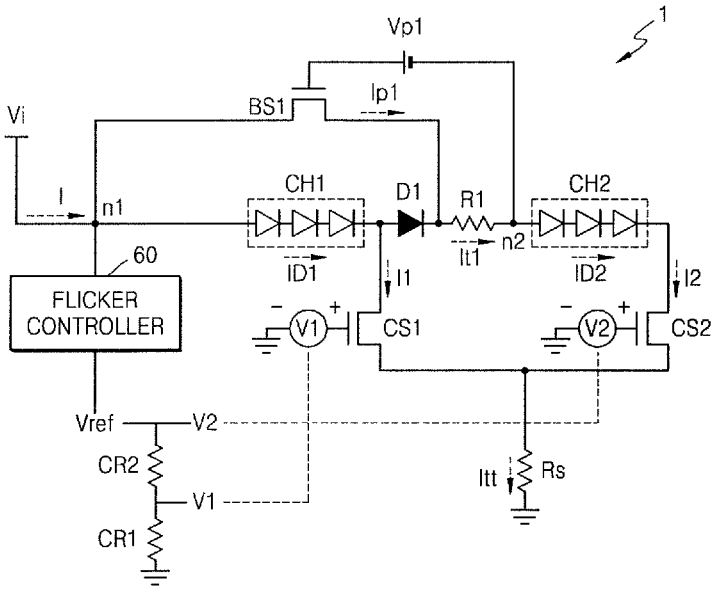
FIG. 11 is a diagram showing an LED lighting circuit including a flicker controller, according to an embodiment of the present invention.

FIG. 11 is a diagram showing an LED lighting circuit 1 including a flicker controller 60, according to an embodiment of the present invention. The LED lighting circuit 1 according to the current embodiment further includes the flicker controller 60 compared to the LED lighting circuit 1 of FIG. 1A, and thus a repeated description between the two embodiments is not provided here.

Referring to FIG. 11, the flicker controller 60 may be connected to an input node n1 through which power or a current is input, to control flicker of the light-emitting groups CH1 and CH2. For example, the flicker controller 60 may be connected between the input node n1 and a current bypass output node. On-off states of the distribution switches CS1 and CS2 may be controlled based on bias voltages V1 and V2 applied through gates thereof. For example, these bias voltages V1 and V2 may be set by dividing a reference voltage Vref.

The flicker controller 60 may prevent flicker of the light-emitting groups CH1 and CH2 by controlling the bias voltages V1 and V2 applied to the distribution switches CS1 and CS2, in association with input power Vi. For example, the bias voltages V1 and V2 may be set by dividing the reference voltage Vref using resistors CR1 and CR2 connected to each other in series. The flicker controller 60 may be connected to the input voltage Vi and may be configured to set the reference voltage Vref to 0 and thus to turn off the light-emitting groups CH1 and CH2 when the input voltage Vi is equal to or lower than a predetermined voltage which causes flicker of light.

In addition to the lighting device of FIG. 1A, the flicker controller 60 may also be included in the lighting circuits or lighting devices of FIGS. 2 to 10C to control bias voltages.

Figure 12:
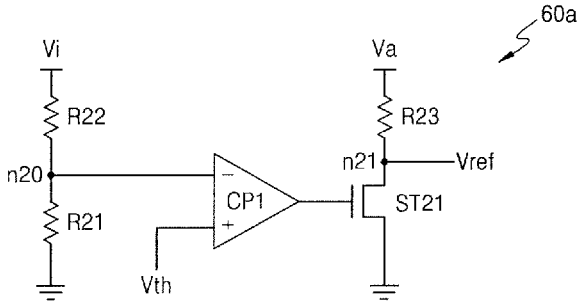
FIG. 12 is a diagram showing an example of a flicker controller applied to an LED lighting circuit according to embodiments of the present invention.

FIG. 12 is a diagram showing an example of a flicker controller 60*a* applied to an LED lighting circuit according to embodiments of the present invention. For example, the flicker controller 60*a* may be at least a part of the flicker controller 60 illustrated in FIG. 11.

Referring to FIGS. 11 and 12, the flicker controller 60*a* may adjust the reference voltage Vref based on the input voltage Vi using a comparator CP1. In detail, the input voltage Vi may be connected to a resistor R22, and the resistor R22 may be connected through a node n20 to a resistor R21 in series. As such, the potential of the node n20 may be determined based on the values of the two resistors R21 and R22, and has a value of Vi*R21/(R21+R22) in the circuit of FIG. 12.

A minus (−) node of the comparator CP1 may be connected to the node n20, and a plus (+) node thereof may be connected to a threshold voltage Vth. An output node of the comparator CP1 is connected to a gate of a transistor ST11, and one end of the transistor ST11 is connected through a resistor R23 to a voltage Va and another end thereof is grounded. The reference voltage Vref is connected to a node n21 provided between the one end of the transistor ST11 and the resistor R23.

According to the above description, when the input voltage Vi is lower than a comparative voltage, i.e., Vth*(1+R22/R21), output of the comparator CP1 is in an high state and thus the reference voltage Vref is 0V. In this case, both the bias voltages V1 and V2 have a value of 0V and thus the light-emitting groups CH1 and CH2 are both turned off. Otherwise, when the input voltage Vi is higher than the comparative voltage, the output of the comparator CP1 in a low state and thus the reference voltage Vref has a value of Va. In this case, one or both of the light-emitting groups CH1 and CH2 are turned on based on the magnitude of Va.

Using this flicker controller 60*a*, when the input voltage Vi is equal to or lower than the comparative voltage, both the light-emitting groups CH1 and CH2 may be turned off and thus the LED may not flicker.

Figure 13:
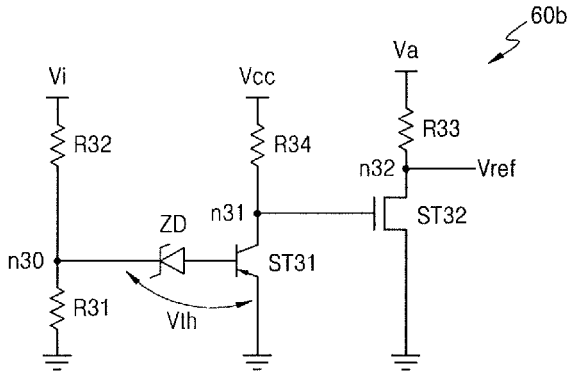
FIG. 13 is a diagram showing another example of a flicker controller applied to an LED lighting circuit according to embodiments of the present invention.

FIG. 13 is a diagram showing another example of a flicker controller 60*b* applied to an LED lighting circuit according to embodiments of the present invention. For example, the flicker controller 60*b* may be at least a part of the flicker controller 60 illustrated in FIG. 11.

Referring to FIGS. 11 and 13, the flicker controller 60*b* may adjust the reference voltage Vref based on the input voltage Vi using a Zener diode ZD. In detail, two resistors R31 and R32 are connected to each other in series by intervening a node n30 therebetween, and the input power Vi is connected through the resistor R32. One end of the Zener diode ZD is connected to the node n30, another end thereof is connected to a gate of a transistor ST31, and the Zener diode ZD is provided in such a manner that a direction from the one end to the other end is reversed. A voltage Vcc is connected through a resistor R34 to one end of the transistor ST31, and another end of the transistor ST31 is grounded. A node n31 between the resistor R34 and the one end of the transistor ST31 is connected to a gate of a transistor ST32. A voltage Va is connected through a resistor R33 to one end of the transistor ST32, and another end of the transistor ST32 is grounded. The reference voltage Vref is connected to a node n32 between the resistor R33 and the transistor ST32.

According to the above description, when the input voltage Vi is lower than a comparative voltage, i.e., Vth*(1+R32/R31), the transistor ST31 is turned off and thus the potential of the node n31 is Vcc. As such, the transistor ST32 is turned on and thus the reference voltage Vref is 0V. In this case, both the bias voltages V1 and V2 have a value of 0V and thus the light-emitting groups CH1 and CH2 are both turned off. Otherwise, when the input voltage Vi is higher than the comparative voltage, the transistor ST31 is turned on, 0V is applied to the gate of the transistor ST32, the transistor ST32 is turned off, and thus the reference voltage Vref has a value of Va. In this case, one or both of the light-emitting groups CH1 and CH2 are turned on based on the magnitude of Va.

Using this flicker controller 60*b*, when the input voltage Vi is equal to or lower than the comparative voltage, both the light-emitting groups CH1 and CH2 may be turned off and thus the LED may not flicker.

The above-described LED lighting device is configured in such a manner that AC power is rectified using a bridge diode, that the numbers of parallel- and serial-connected LED groups are automatically adjusted based on a voltage level of the rectified ripple voltage, and that a total current applied to the LED group is increased based on voltage levels. As such, a power factor and efficiency may be simultaneously improved. Furthermore, flicker of light which is caused when the light is dimmed may be prevented by adding a flicker controller.

Figure 14:
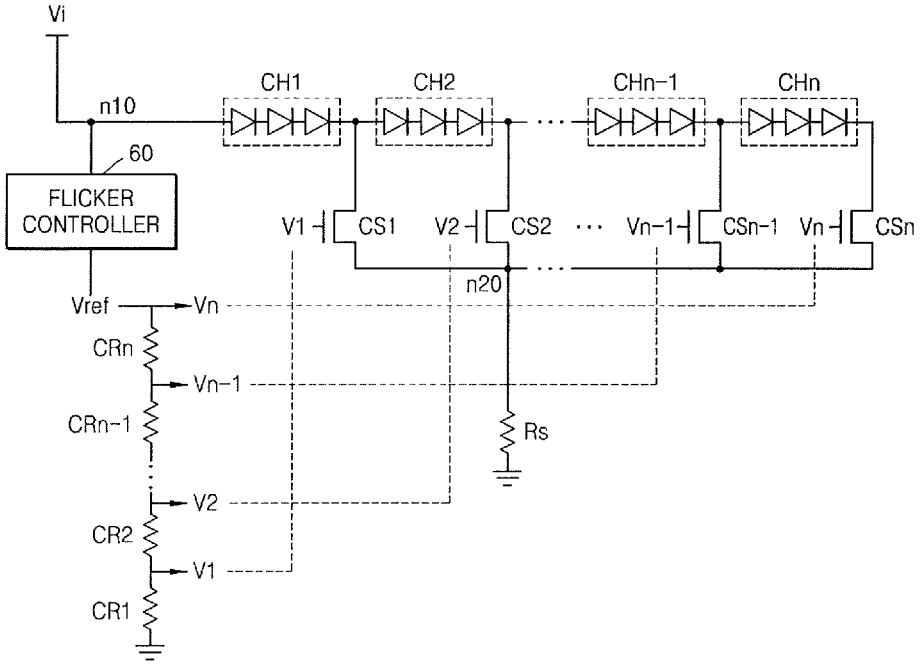
FIG. 14 is a diagram showing an LED lighting circuit including a flicker controller, according to another embodiment of the present invention.

FIG. 14 is a diagram showing an LED lighting circuit including a flicker controller 60, according to another embodiment of the present invention. The LED lighting circuit of FIG. 14 is similar to the LED lighting circuit 1 of FIG. 11 except that no bypass circuit is included and the number of light-emitting groups is increased to n, and thus a repeated description between the two embodiments is not provided here.

Referring to FIG. 14, n light-emitting groups CH1 to CHn are connected to each other in series, and an input voltage Vi may be applied through a current input node n10 to the light-emitting group CH1 of the uppermost stream. Connection nodes between the light-emitting groups CH1 to CHn may be connected through distribution switches CS1 to CSn to a current bypass output node n20, and the current bypass output node n20 may be connected through the resistor Rs to the ground.

Bias voltages V1 to Vn may be applied to gates of the distribution switches CS1 to CSn, and these bias voltages V1 to Vn may be set by dividing a reference voltage Vref. For example, the reference voltage Vref may be divided using resistors CR1 to CRn, and the bias voltages V1 to Vn may be connected to nodes between the resistors CR1 to CRn.

The flicker controller 60 may be connected between the current input node n10 and the current bypass output node n20, for example, between the current input node n10 and the reference voltage Vref. For a description of the flicker controller 60, reference can be made to the descriptions of the flicker controllers 60*a* and 60*b* of FIGS. 12 and 13.

Using this flicker controller 60, when the input voltage Vi is equal to or lower than a comparative voltage, the light-emitting groups CH1 to CHn may be all turned off, and thus flicker of light which is caused when an LED is turned on may be prevented.

The above-described flicker controller of the dimming control LED lighting circuit may also be applied to the lighting circuit or the lighting device of FIGS. 1 to 10, and may be used in a variety of lighting circuits for controlling an LED using a bias voltage.

According to the present invention, a light-emitting diode (LED) lighting device capable of increasing usability of LEDs and improving light output efficiency when alternating current (AC) power is directly applied to the LEDS may be provided.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A lighting device comprising:

a light-emitting unit comprising a current input node, a current output node, a current bypass output node, and a first light-emitting group for emitting light due to a current input to the current input node;

a second light-emitting group connected to receive a current output from the current output node; and a flicker controller provided between the current input node and the current bypass output node to turn off the first and second light-emitting groups when a voltage input to the current input node is equal to or lower than a predetermined voltage, wherein the current output node is configured to selectively output a whole or a part of a current input through the current input node, and wherein the current bypass output node is configured to output a remaining part of the current input through the current input node, when the current output node outputs the part of the current.

2. The lighting device of claim 1, wherein, when the lighting device operates in a steady state, the current bypass output node is configured to output the remaining part of the current input through the current input node, when the current output node outputs the part of the current, and wherein the part of the current has a value greater than 0.

3. The lighting device of claim 1, wherein the remaining part of the current is at least a part or a whole of a current flowing through the first light-emitting group.

4. The lighting device of claim 1, wherein the second light-emitting group belongs to another light-emitting unit comprising another current input node, another current output node, another current bypass output node, and the second light-emitting group for emitting light due to a current input to the other current input node, and wherein the current bypass output node comprised in the light-emitting unit is configured to be connected to the other current bypass output node comprised in the other light-emitting unit.

5. The lighting device of claim 1, wherein distribution switches are separately connected between the first light-emitting group and the current output node and between the second light-emitting group and the other current output node, and wherein the flicker controller turns off the distribution switches to turn off the first and second light-emitting groups using a comparator or a Zener diode connected to the current input node, when the voltage input to the current input node is equal to or lower than a predetermined voltage.

6. The lighting device of claim 1, wherein the current output node is configured to output the part of the current when the voltage input to the current input node has a first potential, and to output the whole of the current when the voltage input to the current input node has a second potential higher than the first potential.

7. A light-emitting device comprising:

a plurality of light-emitting groups electrically connected to each other to be numbered in a direction from an upper stream to a lower stream, and receiving power from a power supply for supplying power having a variable potential;

a first bypass unit;

a second bypass unit; and a flicker controller for turning off the light-emitting groups when a voltage input from the power supply is equal to or lower than a predetermined voltage, wherein each of the light-emitting groups comprises one or more light-emitting elements, wherein the first bypass unit is configured to electrically connect an upper stream node of a first light-emitting group which is arbitrary-numbered, to an upper stream node of a second light-emitting group which is arbitrary-numbered and provided at a lower stream of the first light-emitting group, in an interruptive manner, and wherein the second bypass unit is configured to electrically connect a lower stream node of the first light-emitting group to a lower stream node of the second light-emitting group or a lower stream node of a third light-emitting group which is arbitrary-numbered and provided at a lower stream of the second light-emitting group, in an interruptive manner.

8. The light-emitting device of claim 7, wherein the first bypass unit is configured to serve as a constant current source when the first bypass unit connects the upper stream node of the first light-emitting group to the upper stream node of the second light-emitting group.

9. The light-emitting device of claim 7, wherein the second bypass unit is configured to flow a current therethrough when a current flows through the first bypass unit, and not to flow a current therethrough when a current does not flow through the first bypass unit.

10. An alternating current (AC) power light-emitting diode (LED) lighting device comprising:

a plurality of light-emitting groups linearly and electrically connected to each other to be numbered from an uppermost stream to a lower stream;

a first circuit unit for connecting connection nodes between the light-emitting groups to a ground;

a second circuit unit for bypass-connecting the connection nodes to each other; and a flicker controller for turning off the light-emitting groups when a voltage input to a light-emitting group of the uppermost stream is equal to or lower than a predetermined voltage, wherein the light-emitting groups are configured to be switched from a parallel connection state to a serial connection state sequentially from the light-emitting group of the uppermost stream to a light-emitting group of the lowermost stream while a potential of supplied AC power is increased, and wherein each of the light-emitting groups comprises one or more LED elements.

11. A lighting device comprising:

a light-emitting unit comprising a first light-emitting group, a first bypass unit, a second bypass unit, and a current input node commonly connected to an input node of the first light-emitting group and an input node of the first bypass unit to supply a current to the first light-emitting group and the first bypass unit;

a second light-emitting group connected to the light-emitting unit to receive a current output from an output node of the first light-emitting group in a first circuit state and to receive a current output from an output node of the first bypass unit in a second circuit state; and a flicker controller connected to the current input node to turn off the first and second light-emitting groups when a voltage input to the current input node is equal to or lower than a predetermined voltage, wherein the first bypass unit is configured to be interrupted not to flow a current therethrough, and the second bypass unit is configured to be interrupted not to flow therethrough the current output from the first light-emitting group, in the first circuit state, and wherein the first bypass unit is configured to flow a current therethrough, and the second bypass unit is configured to flow therethrough at least a part of the current output from the first light-emitting group, in the second circuit state.

12. The lighting device of claim 11, wherein the second bypass unit is configured to connect an output node thereof to a current output node of the second light-emitting group.

13. The lighting device of claim 11, wherein the second light-emitting group is comprised in another light-emitting unit having a configuration equal to the configuration of the light-emitting unit.

14. The lighting device of claim 11, wherein the first circuit state indicates a first time period, and wherein the second circuit state indicates a second time period different from the first time period.

15. The lighting device of claim 11, wherein the first circuit state indicates a state having a first input voltage level, wherein the second circuit state indicates a state having a second input voltage level, and wherein the first input voltage level is higher than the second input voltage level.

16. A lighting device comprising:

two light-emitting units connected to each other in parallel at a first voltage higher than a turn-on voltage; and a flicker controller for turning off the two light-emitting units when a voltage input to an upper stream node of the two light-emitting units is equal to or lower than a predetermined voltage, wherein the two light-emitting units are switched to a serial connection state at a second voltage higher than the first voltage, and wherein the two light-emitting units are always turned on at a voltage higher than the turn-on voltage.

17. The lighting device of claim 16, wherein the two light-emitting units comprise light-emitting diodes (LEDs), and wherein the turn-on voltage is a forward voltage of any one of the two light-emitting units.

18. The lighting device of claim 16, wherein a current flowing into the two light-emitting units has a higher value at the second voltage compared to the first voltage.

* * * * *